US005888353A

United States Patent [19]

Powell

[11] Patent Number: 5,888,353

[45] Date of Patent: Mar. 30, 1999

[54] FLATSIDED PARABOLIC HEADER FOR HEADBOXES

[75] Inventor: Anthony Bernard Powell, Southport, England

[73] Assignee: Beloit Technologies, Inc., Wilmington, Del.

[21] Appl. No.: 724,874

[22] Filed: Oct. 3, 1996

[51] Int. Cl.[6] ..... D21F 1/02; D21F 1/00

[52] U.S. Cl. ..... 162/339; 162/336; 162/380; 162/343

[56] References Cited

U.S. PATENT DOCUMENTS

| | | | |
|---|---|---|---|
| 2,728,271 | 12/1955 | Withworth . | |
| 3,486,972 | 12/1969 | Nagell | 162/336 X |
| 3,640,843 | 2/1972 | Means . | |
| 3,963,562 | 6/1976 | Dunlap | 162/343 |
| 4,141,788 | 2/1979 | Justus . | |
| 5,196,091 | 3/1993 | Hergert . | |
| 5,304,285 | 4/1994 | Meinecke et al. | 162/339 |
| 5,510,005 | 4/1996 | Gingerich | 162/343 |

FOREIGN PATENT DOCUMENTS 0029905 6/1981 European Pat. Off. .

OTHER PUBLICATIONS

"Beloit Concept III™ headbox . . . delivers a uniform, full–width, controllable microturbulence to the slice," a brochure published by Beloit Corporation, No. B–307.

"Beloit Technology Update: Concept IV–MH™ Headbox—The Next Generation Converflo," a brochure published by Beloit Corporation, Form No. TU126, Apr. 1993.

U. Begemann, "Modulejet Hheadbox concept operating experience with single and multi–layer headboxes processing different paper grades", Pulp & Paper Canada, 97:8, pp. 20–23, Aug. 1996.

A. Harrison, "New machine designs balance sheet quality, production goals", Pulp & Paper, vol. 68 No. 4, pp. 61–64, Apr. 1994.

D. Sims and S. Pantaleo, "Catawba mill installs the next genereation headbox", Paper Technology, vol. 36 No. 10, pp. 24–31, Dec. 1995.

*Primary Examiner*—Donald E. Czaja
*Assistant Examiner*—Jose A. Fortuna
*Attorney, Agent, or Firm*—Lathrop & Clark

[57] ABSTRACT

For distributing stock evenly across the face of a tube bank in a papermaking machine, the stock supply header has an increasing change in cross-sectional area per unit width traveling from the inlet end to the recirculation end of the header. The header top wall converges toward the bottom wall, while the rear wall converges toward the front wall. The change in cross-sectional area down the header from the inlet end to the recirculation end is thus closely matched to an ideally parabolic shape.

7 Claims, 1 Drawing Sheet

FLATSIDED PARABOLIC HEADER FOR HEADBOXES

FIELD OF THE INVENTION

The present invention relates to papermaking headboxes in general and in particular to stock distribution headers for headboxes.

BACKGROUND OF THE INVENTION

Paper is commonly formed by injecting stock through a headbox onto a moving fourdrinier forming wire screen which moves at approximately the same speed as the flow of stock being ejected from the headbox. In some circumstances the stock is injected between two moving wire screens on a so-called twin wire machine. The stock is a mixture that usually contains one-half to one percent paper fibers and at least ninety-nine percent water. The water is drawn from the stock through the forming screens or wires, leaving a web of paper fibers which is pressed and dried to form a web of paper.

The stock is pumped into the headbox and ejected through a slice lip at an extremely high pressure by means of pumping equipment. An attenuator is disposed upstream relative to the headbox for damping pressure pulses caused by the stock pumping equipment. The arrangement is such that the rate of stock entering the headbox is relatively constant.

Modern papermaking machines are between one hundred and four hundred inches wide and operate at speeds up to and in excess of 4,000 feet per minute. Thus, the headbox and the slice that supply the flow of paper stock which is formed into the paper web must supply not only a large quantity of stock to meet the high forming speeds of modern papermaking processes, but must also supply the stock in an extremely uniform fashion if the sheet of paper formed is to be of uniform thickness across the width of the web, and to have uniform properties throughout.

Typically the stock is injected in a cross-machine direction through an inlet to a tapered inlet header. The inlet header has an array of tube inlets along one side corresponding to a plurality of tubes vertically arrayed in a tube bank through which the stock is diverted towards a nozzle terminating in a slice lip. The tube bank is typically in the neighborhood of six tubes high by several hundred tubes long. Accordingly, it is essential that the rate of flow of stock at the inlet of a tube positioned at one end of the inlet header be the same as the rate of flow of stock at the inlet of a tube positioned at the other end of the inlet header. If the stock has been thoroughly mixed and is of uniform consistency, and if the slice lip opening is the same along the entire cross-machine directional width of the headbox, the weight of the fibers within the stock per inch of width across the ribbon of stock ejected through the slice lip should be constant. The resulting web will have the desired uniform basis weight in the cross-machine direction.

In order to achieve the constant flow rate at the tube inlets located along one side of the inlet header, the inlet header is tapered in the cross-machine direction. In other words, the width of the inlet header decreases moving from the inlet end in the cross-machine direction towards the outlet or recirculation end. In a conventional header, the rate of change in cross-sectional area of the inlet header moving from the inlet end to the recirculation end is constant. This is illustrated by a straight-line relationship in a graph of the change in cross-sectional area versus distance along the inlet header. As a result of the tapered construction, the cross-sectional area of the inlet header moving in the cross-machine direction from the inlet end towards the recirculation end is reduced by an area substantially equal to three times the total cross-sectional area of the individual tube inlets not yet reached upstream of the cross-sectional area of the inlet header. This reduction in cross-sectional area of the inlet header compensates for the pressure lost as a result of the diverted flow of stock through the inlet tubes, thereby maintaining the same pressure at each inlet tube in the inlet header. Consequently, the rate of flow of stock through all the inlet tubes in a cross-machine direction is maintained substantially constant and equal.

In practice, care must be taken to prevent variation in paper weight or thickness in the cross-machine direction. In an effort to maintain a uniform paper weight across the paper web, some paper forming headboxes use actuators placed on the lip of the slice to deform the slice lip, thereby changing the width of the slice opening. In one recently developed system, described in U.S. Pat. No. 5,196,091 to Richard E. Hergert and incorporated herein by reference, the injection of diluting water into the headbox inlet header or manifold adjacent to the tube inlets has been used to control the dilution of the stock in the cross-machine direction. This dilution control in turn acts to control the paper web weight or thickness. This technique has produced paper webs having more uniform characteristics.

In order to obtain the ideal pressure distribution across the tube bank, the change in cross-sectional area per unit width of the headbox will not be constant, but will ideally increase as the header approaches the recirculation end. This type of header is usually known as a parabolic header because a graph of the area versus distance along the header is parabolic rather than straight-lined in nature. One method used to construct a header having the ideal parabolic relation of cross-sectional area from the inlet end to the recirculation end using a straight-tapered inlet header is to construct the inlet header with at least one side curved in the cross-machine direction. Another is to use a series of straight-tapered sections with differing tapers. Both of these solutions are complicated and expensive to produce.

Because the ideal pressure distribution across the tube bank is achieved with a header having a parabolic increase in change in cross-sectional area as it approaches a recirculation end, there is a need to construct a parabolic header that is as easy and cost-efficient to produce as a single straight-tapered header.

SUMMARY OF THE INVENTION

The inlet header of the present invention has an approximately parabolic change in cross-sectional area per unit width of the headbox as it approaches the recirculation end. The inlet header is a four sided box which extends from an inlet end to an outlet or recirculation end. Although each side of the box is planar, no two sides are parallel. The inlet header has a top side which converges toward a bottom side from the inlet end towards the recirculation end. The header top and bottom sides are connected by an upstream side and a downstream side which encompass the tube bank. The upstream side and the downstream side, while extending primarily in the z-direction, diverge from the inlet end towards the recirculation end. Although no two sides are parallel, all sides are planar, easily manufactured quadrilaterals.

The recirculation depth of the header is chosen relative to the inlet depth to give ten percent recirculation. The inlet width of the header is chosen to be less than the outlet width in such a way that the ratio of the change in cross-sectional area down the header from the inlet end to the outlet end is closely matched to the ideally parabolic shape.

It is a feature of the present invention to provide an inlet header for a papermaking machine which maintains a uniform paper weight across the web.

It is another feature of the present invention to provide an inlet header having an approximately parabolic change in cross-sectional area.

It is a further feature of this invention to provide an inlet header for a papermaking machine headbox which is economical to produce.

Further objects, features and advantages of the invention will be apparent from the following detailed description when taken in conjunction with the accompanying drawings.

DESCRIPTION OF THE PREFERRED EMBODIMENT

Figure 4:
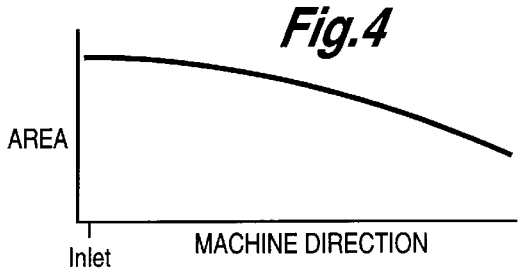
FIG. 4 is a graph of the relation between header area and position along the header of the header of FIG. 3, illustrating the parabolic relationship of the header of this invention.
Figure 5:
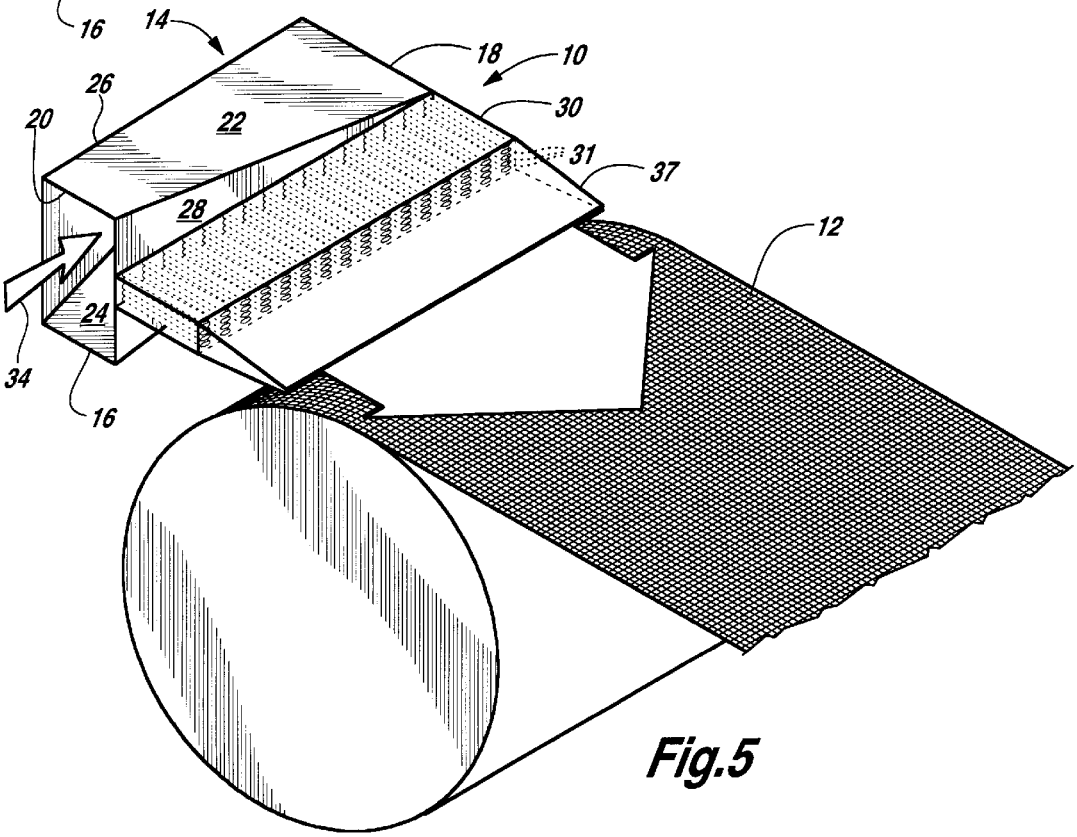
FIG. 5 is a isometric view in somewhat schematic form of a papermaking headbox employing the header of FIG. 3 and discharging stock onto a forming wire.

Referring more particularly to FIGS. 1–5, wherein like numbers refer to similar parts, a headbox 10 for a papermaking machine is shown in FIG. 5. The headbox 10 ejects stock through a converging nozzle 37 onto a forming wire 12 for forming a web. The headbox apparatus 10 is supplied with stock by an inlet header 14, which is connected to a pressurized source of stock, not shown.

The inlet header 14 is tapered from an inlet opening 16 towards an outlet or recirculation opening 18. Papermaking stock is introduced into the header chamber 20 defined between the inlet opening 16 and the recirculation opening 18. The header chamber 20 acts as a conduit for infed papermaking stock to the tubes of a tube bank, and has a top wall 22 positioned above a bottom wall 24. The top wall 22 and bottom wall 24 are connected by an upstream wall 26 and a downstream wall 28. A tube bank 30, comprised of an array of individual tubes 31, extends from the downstream wall 28. Stock introduced into the header 14 flows through tube openings 32 in the downstream wall 28 into the tubes 31 and into the nozzle 37. The upstream wall 26 and the downstream wall 28 diverge as the header extends from the inlet opening 16 to the recirculation opening 18, while the top wall 22 and the bottom wall 24 converge. Although none of the walls 22, 24, 26, 28 are rectangular, they are all planar quadrilaterals.

As the stock 34 flows through the inlet header 14 in the cross-machine direction, a portion of the flow is diverted into successive tubes 31 of the tube bank 30. The stock flows at a substantially constant flow rate through the interior 20 of the inlet header 14 and is diverted through the plurality of tubes 31 into the nozzle 37. The shape of the header contributes to the consistent flow of stock into the tubes 31.

Figure 1:
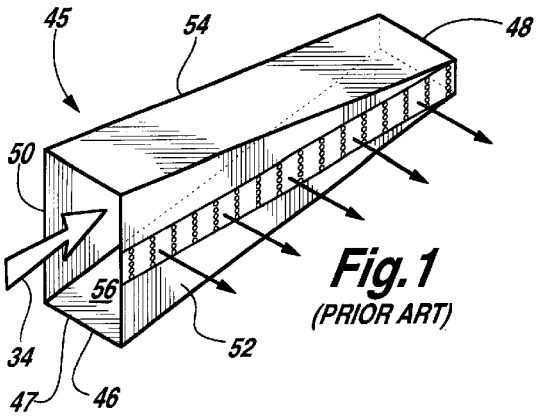
Fig.1 (PRIOR ART)
FIG. 1 is an isometric view of an inlet header of a prior art headbox arrangement.

A prior art header 45, shown in FIG. 1, has a header chamber 46 with an inlet 47 and a recirculation outlet 48. The prior art header chamber 46 is defined by an upstream wall 50 which is parallel to a downstream wall 52. Hence the width (W) of the header is constant with change in cross-machine direction position ($X_{CD}$). The prior art header has a top wall 54 which converges toward the bottom wall 56 such that there is a straight-line relationship between the position in the cross-machine direction and the height (H) of the header 46.

$$W=W_{inlet}$$

$$H=H_{inlet}-Mx_{CD}$$

Figure 2:
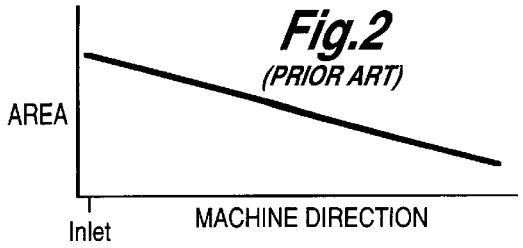
Fig.2 (PRIOR ART)
FIG. 2 is a graph of the relation between header area and position along the header of the header of FIG. 1, illustrating the straight line relationship of the prior art header.
Figure 3:
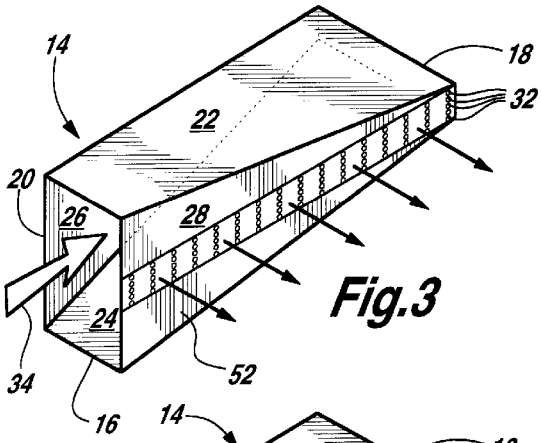
FIG. 3 is an isometric view of an inlet header of the present invention for a papermaking headbox, the inlet header having a parabolic relation between header area and cross-machine direction position.

There is thus a straight line relation between the cross-sectional area of the header and cross-machine direction position, as shown in the graph of FIG. 2.

$$\text{Area}=W_{inlet}(H_{inlet}-Mx_{CD})$$

The height at the recirculation end is typically calculated in relation to the height at the inlet end to give ten percent recirculation. The straight-line header 46 results in a change in cross-sectional area from the inlet 47 to the recirculation outlet 48 that is constant as the area decreases.

The header 14 of this invention, on the other hand, has a change in cross-sectional area per unit width of the headbox which is not constant, but which increases as the header approaches the recirculation side. This type of header is known as a parabolic header. Yet the parabolic distribution is achieved without any curved plates in the header construction. The parabolic distribution is a consequence of the fact that the cross-sectional area of the header is the product of the height (H) and width (W) of the headbox at any given point moving in the machine direction from one end to the other of the header.

$$\text{Area}=HW$$

Both the width and the height of the header with respect to position in the cross-machine direction ($X_{CD}$) at any point along the header are described by linear equations.

$$H=H_{inlet}-M_1x_{CD}$$

$$W=W_{inlet}+M_2x_{CD}$$

Because the height of the header has a negative taper the linear equation describing the vertical dimension of the header will have negative slope ($-M_1$) such that the height of the header will change from an initial height ($H_{inlet}$) in a decreasing linear fashion with distance in the cross-machine direction. The width of the headbox has a positive taper or a positive slope ($M_2$) and therefore the width increases from an initial width ($W_{initial}$) with increasing position along the header in the machine direction.

Because the area is the product of the width and the height the two linear equations describing the height and the width must be multiplied together:

$$\text{Area}=H_{inlet}W_{inlet}-M_1M_2x^2_{CD}+(H_{inlet}M_2-W_{inlet}M_1)x_{CD}$$

Because one of the equations varies negatively with x and the other positively with x, the second order term, with respect to x, will be negative. Hence the area of the header will fall steeply for large x. The initial dimensions of the headbox together with the slope of the width and height can be selected to vary the characteristic of the parabolic slope.

The parabolic inlet header 14 results in a change in cross-sectional area from the inlet 16 to the recirculation outlet 18 that increases as the area decreases, resulting in a parabolic relation 65 as shown in the graph in FIG. 4.

In the design of a flat sided parabolic header, the area of the inlet and the area of the outlet are generally known design parameters. For example, the area of the outlet may be chosen to be ten percent of the area of the inlet and the area of the inlet to be approximately 110 percent of the area necessary to pass the required volume to the individual tubes 31 making up the tube bank 30. Furthermore, the vertical dimension of the downstream or supply wall 28 must remain of sufficient height to allow placement of all the tubes 31. Because it is desirable that the total cross-sectional area be constantly decreasing, it is desirable that the linear term of the quadratic equation of the area be negative. This in turn implies that the negative slope of the converging top and bottom sides times the initial width of the diverging upstream and downstream sides should be equal to or greater than the positive slope of the diverging side times the initial height of the converging side.

The advantage of the present invention is that by carefully choosing recirculation outlet width versus inlet width, the change in cross-sectional area down the header from the inlet 16 to the recirculation outlet 18 can be closely matched to the theoretically ideal parabolic shape. This makes the parabolic header more ideal yet as cost-efficient to produce as the straight-tapered header.

It is understood that the invention is not limited to the particular construction and arrangement of parts herein illustrated and described, but embraces such modified forms thereof as come within the scope of the following claims.

What is claimed is:

1. A header for distributing stock evenly across the face of a tube bank comprising:

a planar top wall;

a planar bottom wall spaced beneath the top wall;

a planar upstream wall extending between the top wall and the bottom wall; and a planar downstream wall spaced from the upstream wall and extending between the top wall and the bottom wall, wherein portions of the top wall, the bottom wall, the upstream wall, and the downstream wall define a header inlet and a recirculation outlet which is spaced in the cross-machine direction from the inlet, and wherein portions of the downstream wall define a plurality of tube openings through which stock introduced into the header may escape for entrance into the tubes of a tube bank, and wherein the top wall converges toward the bottom wall from the inlet to the recirculation outlet, and the upstream wall diverges from the downstream wall from the inlet to the recirculation outlet, to thereby facilitate distribution of papermaking stock infed at the inlet evenly over the tube openings.

2. A header for distributing stock across the face of a tube bank comprising a pair of spaced apart symmetric diverging walls joined by a pair of spaced apart symmetric converging walls to form a stock conduit for transporting stock to a tube bank disposed in a cross-machine direction, wherein the area of the inlet is greater than the area of the outlet and wherein one of said sides has portions defining a multiplicity of fluid openings through which papermaking stock may flow in a machine direction towards a nozzle for distributing stock on a forming wire.

3. The apparatus of claim 2 wherein the area of the inlet of the conduit is approximately ten times the area of the outlet of the conduit.

4. The apparatus of claim 2 wherein the conduit defines a cross section having a cross-sectional area which is transverse to the direction of flow through the conduit at every point along the conduit in a cross-machine direction, and wherein said cross section is rectangular in shape, said rectangular cross section having first parallel sides and second parallel sides, said first parallel sides corresponding to the converging walls and said second parallel sides corresponding to the diverging walls.

5. The apparatus of claim 4 wherein the distance between the first parallel sides of said rectangular cross section of the conduit as it extends from the stock inlet to the stock outlet is described by a linear equation having the distance between the first parallel sides at the inlet minus a constant representing the absolute value of a linear negative slope times a distance in the machine direction; and wherein the distance between the second parallel sides of the said rectangular cross section as it extends from the stock inlet to the stock outlet is determined by a linear equation having the distance between the second parallel sides at the inlet plus a constant representing a positive slope times the displacement in the machine direction towards the outlet; and wherein the relationship of the inlet dimensions of the first and second sides and wherein the relation of the negative slope of the converging side and the positive slope of the diverging second side are such that when the equation describing the distance between the first sides is multiplied times the equation describing the distance between the second sides so as to give the area at any point along the conduit in relation to the cross-machine direction, the linear term of said equation is zero or negative such that the cross-sectional area of the conduit always decreases from the flow inlet to the flow outlet.

6. A headbox in a papermaking machine comprising:

a converging slice chamber;

a plurality of tubes forming a tube bank which discharges into the slice chamber;

a header connected to the tube bank to direct papermaking stock into the tubes, wherein the header has a conduit extending between a header inlet and a header outlet, and wherein the header has four substantially planar walls, comprising two first nonadjacent walls and two second nonadjacent walls, and wherein the two first nonadjacent walls of the conduit converge from the inlet to the outlet, and the two second nonadjacent walls diverge from the inlet to the outlet, and wherein the cross-sectional area of the conduit taken along a plane which is perpendicular to the cross-machine direction decreases from the inlet to the outlet and is a function of the value of the cross-machine direction, $X_{CD}$, according to the relationship $$\text{Area}=H_{inlet}W_{inlet}-M_1M_2x^2_{CD}+(H_{inlet}M_2-W_{inlet}M_1)x_{CD}$$

wherein $H_{inlet}$ is the distance between the two first nonadjacent walls at the inlet, $W_{inlet}$ is the distance between the two second nonadjacent walls at the inlet, and $M_1$ is the slope of the convergence of the two first nonadjacent walls, and $M_2$ is the slope of the divergence of the two second nonadjacent walls.

7. The headbox of claim 6 wherein the tube bank extends from one of the two second nonadjacent walls.

* * * * *